United States Patent [19]

Brooke

[11] 4,262,473

[45] Apr. 21, 1981

[54] METHOD AND APPARATUS FOR MANUFACTURING TEA BAGS AND THE LIKE

[75] Inventor: Arthur A. Brooke, Toronto, Canada

[73] Assignee: Delamere & Williams Company, Limited, Toronto, Canada

[21] Appl. No.: 60,080

[22] Filed: Jul. 24, 1979

[51] Int. Cl.[3] ..... B65B 9/12

[52] U.S. Cl. ..... 53/450; 53/451; 53/548; 53/551

[58] Field of Search ..... 53/450, 562, 451, 555, 53/548, 550, 551, 552, 452

[56] References Cited

U.S. PATENT DOCUMENTS

| | | | |
|---|---|---|---|
| 2,134,862 | 11/1938 | Dunnam | 53/550 X |
| 2,139,039 | 12/1938 | Salfisberg | 53/562 |
| 2,180,966 | 11/1939 | Salfisberg | 53/550 X |
| 2,475,617 | 7/1949 | Irmscher | 53/450 |
| 3,024,581 | 3/1962 | Cloud | 53/550 X |
| 3,210,908 | 10/1968 | Samberg | 53/555 X |

*Primary Examiner*—Horace M. Culver

*Attorney, Agent, or Firm*—Rogers, Bereskin & Parr

[57] ABSTRACT

A method and apparatus for manufacturing tea bags and the like is disclosed. The bags are made by forming a web into a flattened closed tube while continuously introducing tea and the like into the tube and pinching the tube at successive locations along transverse pinch lines corresponding generally to the required bag length. The tube is then caused to travel upwardly so that the tea tends to migrate downwardly under gravity and creates voided areas below the pinch locations and the tube is then heat sealed transversely in those voided areas. Finally, the bags are severed from the tube along lines disposed generally centrally of each transverse heat seal.

17 Claims, 12 Drawing Figures

METHOD AND APPARATUS FOR MANUFACTURING TEA BAGS AND THE LIKE

This invention relates generally to the manufacture of tea bags and the like.

At the present time, most tea bags are manufactured by techniques which involve heat sealing measured portions of tea in individual pouches or pockets (bags) made of porous filter material. The bags are typically of generally rectangular shape and may have heat seals along all four sides, or along three sides only, with a fold along the fourth side. The four seal type of bag is popular mainly in Europe and is manufactured using high speed multi-lane heat sealing machines. An example of this general type of machine is shown by U.S. Pat. No. 3,210,908 (Samberg). The three seal type of bag on the other hand predominates in the North American market, and has the advantage that characteristics such as size, style (plain or gusseted) and the amount of tea in each bag can be readily varied in manufacture. Also, such bags are economical in terms of the filter material required to make the bags. Another significant factor is that three seal bags can readily be provided with tags for facilitating immersion of a bag in water and its subsequent removal, while this feature cannot as readily be incorporated in four seal bags.

Machines presently used to produce the three seal bags, however, have inherently lower production rates than the high speed multi-lane machines used to produce the four seal bags, resulting in higher production costs for the three seal bag. U.S. Pats. Nos. 2,475,617 (Irmscher) and 2,139,039 (Salfisberg) show examples of this type of machine. Generally, such machines are designed to operate by folding a continuous travelling web of porous material upwardly about a longitudinal fold line and sealing the folded sides of the web together along vertical seal lines spaced longitudinally of the web, to define a plurality of open-topped pockets or pouches. Measured amounts of tea are introduced from above into each pocket or pouch and the pockets or pouches are then sealed and separated from the web to form the individual bags.

An object of the present invention is to provide an improved method and apparatus which may be used for manufacturing tea bags and the like.

The method provided by the invention includes an initial step of continuously forming at least one web of a porous heat sealable material into a flattened, closed tube having opposed upper and lower walls while introducing a continuous stream of tea and the like into the tube. The tube is caused to travel generally horizontally following introduction of the tea and the like. The travelling tube is then pinched to cause said upper and lower walls move towards one another at successive locations along pinch lines disposed transversely of the tube and spaced longitudinally of the tube to correspond generally to the required bag length. Subsequently, the tube is caused to travel upwardly so that the tea and the like tends to migrate downwardly under gravity away from each said pinch line, creating a voided area immediately below each pinch line. The upper and lower walls of the tube are then heat sealed together along successive bands each disposed in one of said voided areas of the tube and extending transversely of the tube to form a heat seal. Successive sections are then separated from the tube to form individual tea and like bags or groups of such bags by severing the tube along lines each disposed generally centrally of one of the heat seals so that portions of each seal on opposite sides of said line form end seals of successive bags.

The invention also provides an apparatus for manufacturing tea bags and the like. The apparatus includes means for continuously conveying at least one web of a porous heat sealable material along a path which includes a generally horizontal portion followed by a portion along which the tube travels upwardly. Means is provided for forming said at least one web into a flattened closed tube having upper and lower walls while introducing a continuous steam of tea and the like into the tube. The apparatus also includes means for pinching the travelling tube to cause said upper and lower walls to move towards one another at successive locations along pinch lines disposed transversely of the tube while the tube is travelling along said generally horizontal portion of its path. Said lines being spaced longitudinally of the tube to correspond to the required bag length. The pinching means is adapted to maintain the tube in its pinched condition along said upward portion of its path so that the tea and the like tends to migrate downwardly under gravity away from each said pinch line, creating a voided area immediately below each said line. Means is provided for heat sealing the upper and lower walls of the tube together along successive bands each disposed in one of said voided areas of the tube and extending transversely of the tube, to form a heat seal. The apparatus also includes means for separating successive sections from the tube to form individual tea and like bags or groups of such bags, said means being adapted to sever the tube along lines each disposed generally centrally of one the heat seals so that portions of each seal on opposite sides of said line form end seals of successive bags.

In order that the invention may be more clearly understood, reference will now be made to the accompanying drawings which illustrate a preferred embodiment of the invention by way of example, and in which.

Figure 1:
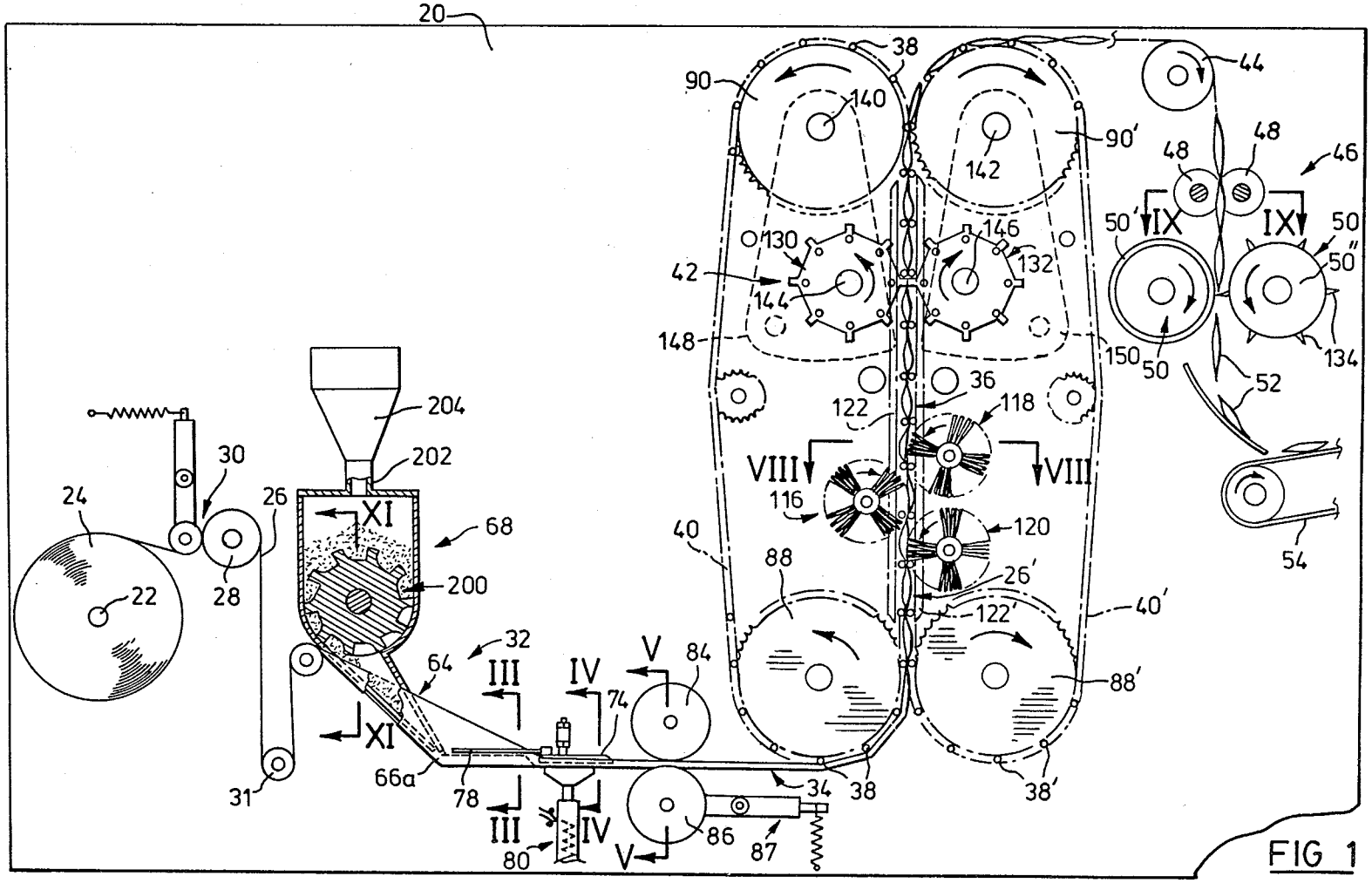
FIG. 1 is a diagrammatic elevational view of an apparatus according to the invention.

Reference will first be made to FIG. 1 in describing the principal components of the apparatus. The apparatus is mounted on a generally vertical base plate 20 and includes an arbor 22 supporting a supply roll 24 of a web of a porous heat sealable material such as is conventionally used for making tea bags. The web itself is designated by reference numeral 26. Web 26 is continuously conveyed from the supply roll 24 by a driven draw roll 28 which forms part of a conventional tension controlling roller arrangement 30. From roll 28 the web passes around a dancer roll 31 and on to a tube forming and filling station generally denoted by reference numeral 32. At this station, the web is formed into a flattened closed tube while a continuous stream of tea is introduced into the tube as will be more specifically described later primarily with reference to FIGS. 2 to 5.

Immediately downstream of the forming and filling station 32, the formed tube travels along a generally horizontal portion 34 of its path. Adjacent the end of this portion of its path the tube is pinched by pinch bars and is carried upwardly and along a vertical portion 36 of its path. The pinch bars are arranged in two series and the bars in each series are carried by a pair of roller chains. The bars in one of said series are indicated by reference numeral 38 and are carried by roller chains 40 while the bars and chains in the other series are denoted by corresponding primed numerals. Each series of bars and associated chains also in effect form a conveyor for the tube. The tube is initially pinched by the bars 38 in the first series at the end of the horizontal portion 34 of its path but as the tube enters the upright portion 36 of its path, it is acted on by the pinch bars of both series. Thus, the chains 40, 40' are synchronised as will be more specifically described later so that the bars 38 and 38' co-operate along the vertical portion 36 of the path of the tube to pinch the tube from both sides. This pinching action will be described in detail with reference primarily to FIG. 6 of the drawings.

With continued reference to FIG. 1, reference numeral 42 indicates a heat sealing station at which the upper and lower walls of the tube are sealed together along transverse seal bands to in effect form the individual bags.

At the top of the upright portion 36 of its path, the formed tube travels horizontally and over an idler roll 44 and then down to a severing station 46. At this station, a first pair of cutter rolls 48 form a longitudinal cut in the tube, while a second pair of cutter rolls 50 separate successive sections form the tube to form the individual tea bags. The individual bags (such as that indicated at 52) then fall down onto a output conveyor 54 by which they are transported to a packing station (not shown).

Figure 5:
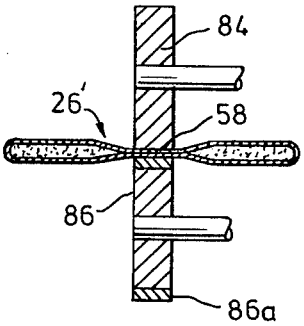
FIGS. 3, 4 and 5 are cross-sectional views on lines III—III, IV—IV, and V—V of FIG. 1.
Figure 2:
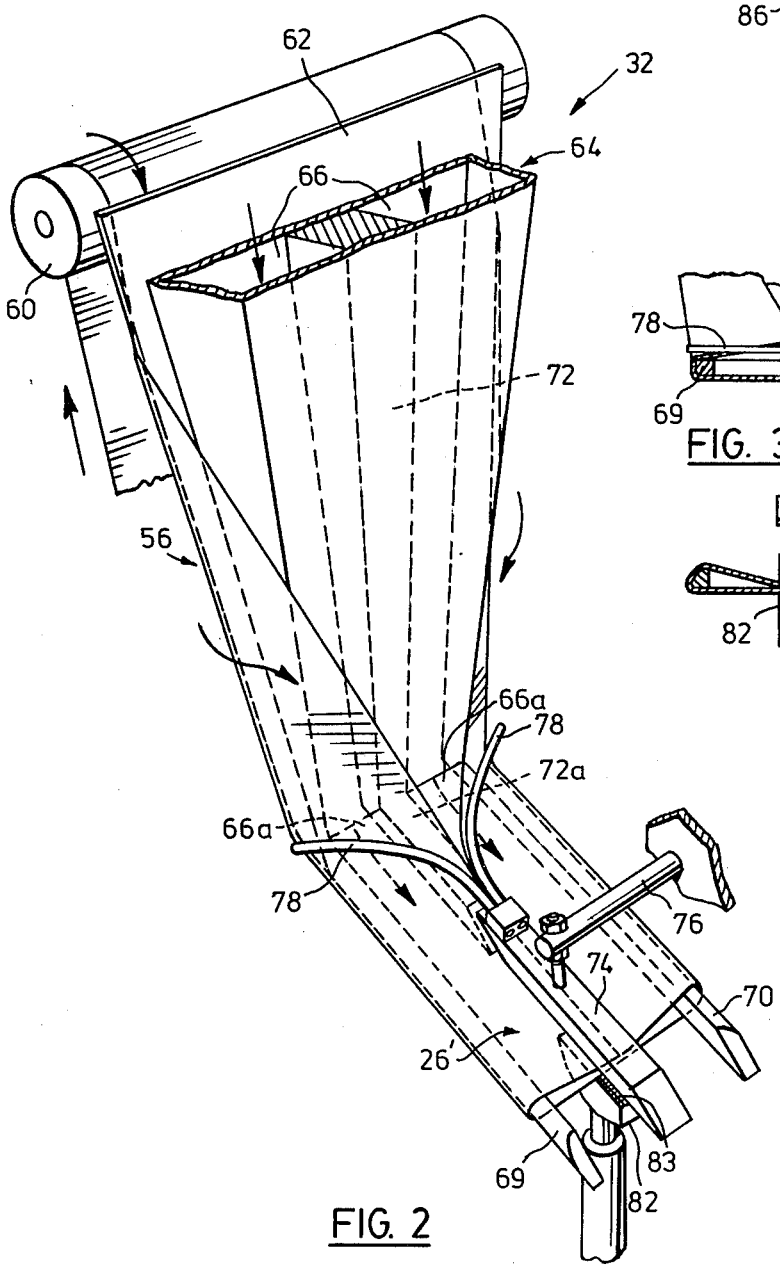
FIG. 2 is a perspective view of the tube forming and filling part of the apparatus of FIG. 1.

Referring now to FIG. 2, there is provided at the forming and filling station 32, a device 56 for continuously forming web 26 into a flattened, closed tube having opposed upper and lower walls while introducing a continuous stream of tea into the tube. In fact, in this paticular embodiment, two streams of tea are introduced into the tube because the tube is to be used to manufacture tea bags arranged in two side by side rows extending longitudinally of the tube as will become apparent. The formed tube is designated by reference numeral 26' and its final shape is best illustrated by FIG. 5, from which it will be seen that the tube has the general shape of a figure of eight. This is due to the presence of a continuous longitudinal heat seal 58 (see later).

With continued reference to FIG. 2, it will be seen that a horizontally disposed idler roll 60 is disposed immediately upstream of device 56 and that the web passes over roll 60 and then downwardly behind device 56. The device includes a folding plate 62 of inverted, truncated triangular shape which extends downwardly from roll 60 at an inclination to the horizontal of the order of 45° (see FIG. 1). Web 26 is drawn downwardly behind plate 62 and then passes forwardly over the bottom edge of the plate and along the horizontal portion 34 of its path. Attached to the front face of plate 62 is a chute 64 which is of a shape generally similar to the shape of plate 62 and which has two internal passageways 66 down which continuous streams of tea are delivered from a tea feeding device generally indicated at 68 in FIG. 1. Device 68 will be described more specifically later primarily with reference to FIGS. 11 and 12. For the present, it is sufficient to note that the device is capable of providing a continuous feed of tea in two streams and that the device can be adjusted to vary the rate at which tea is delivered and the amount of tea in each stream; normally, the streams will contain equal amounts of tea.

Two arms 69 and 70 project forwardly from the lower end of chute 64 in parallel horizontal positions and define the width of the tube 26' formed by device 56. The two passageways 66 in chute 64 are separated by a member 72 which extends from top to bottom of the chute and a forward extension **72*a* of member 72 projects forwardly from the lower end of the chute parallel to the arms 69 and 70 although it is of somewhat shorter length than the arms. The passageways 66 have outlets 66*a* at the bottom of chute 64 between extension 72*a* and the two arms. The extension serves to keep the two streams of tea separate until the longitudinal heat seal 58 has been formed in tube 26'** as will be described.

Figure 4:
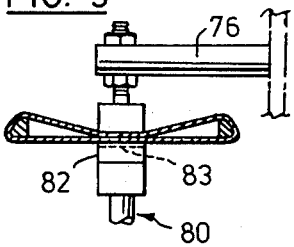

A stationary presser bar 74 is mounted in fixed position just downstream of the bottom end of chute 64 parallel to the arms 69 and 70 as can best be seen in FIG. 4. Bar 74 is carried by a fixed support bracket 76 attached to the base plate 20 of the apparatus. Two arcuate shaped forming bars 78 project forwardly from presser bar 74 and curve outwardly in front of the bottom of chute 64 to in effect "lead" the marginal portions of web 26 inwardly and downwardly below bar 74. The side edges of the arms 69 and 70 and of the folding plate 62 are rounded so that the web can run smoothly around those parts during its transition from a flat web form to a closed tubular "figure of eight" form. It will of course be appreciated that the web will be initially threaded through the machine by hand and led around device 56 along the remainder of its path before the machine can run on a continuous basis.

Figure 3:
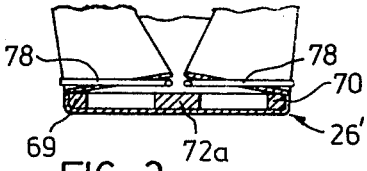

FIGS. 3, 4 and 5 in effect illustrate three transitional forms of the web as it is folded to its final shape. With particular reference to FIGS. 3 and 4, it will be seen that the marginal edges of the web are brought together substantially in abutting relationship below the presser bar 74. The bar depresses the upper wall of the web somewhat, preparatory to the formation of the heat seal 58 (FIG. 5). A hot air gun 80 is disposed below the presser bar at the lower side of the web and includes a nozzle 82 having a screen 83 (FIGS. 2 and 4) of porous stainless steel material over which the web runs and through which hot air issues against the web. Immediately downstream of the presser bar 74 and gun 80 are a pair of sealing rollers 84 and 86 disposed on the longitudinal median line of the web. Rollers 84 and 86 define a nip through which the web passes and the rollers squeeze together the upper and lower walls of the formed tube to form the longitudinal heat seal 58. Thus, the hot air gun 80 heats the web to a temperature sufficient to cause the upper and lower walls of the tube to adhere together under the pressure of the sealing rollers 84 and 86.

Sealing roller 84 is driven by infinitely variable drive means (not shown) and assists in drawing the web through the tube forming and filling station 32 and appropriately controlling the tension in the formed tube. The roller has a knurled peripheral surface which causes a ribbed pattern to be imparted to the longitudinal heat seal 58. Roller 86 on the other hand is an idler roller and is spring biased towards to roller 84 by a conventional biassing arrangement generally indicated at 87 in FIG. 1. Roller 86 has a resilient peripheral surface as indicated by reference numeral 85*a* in FIG. 5.

It will be appreciated from the foregoing that the web will accordingly leave the sealing rollers 84 and 86 in the form of a closed tube having a longitudinally extending central heat seal defining two side by side passageways which extend longitudinally of the web and each of which contains a continuous stream of tea. This "tube" then passes to the first series of pinch bars 38 carried by roller chains 40 (see FIG. 1). As indicated previously, the pinch bars 38 extend between two similar roller chains which travel in an identical endless path. Only one of these chains can be seen in FIG. 1; the other chain will be directly behind the visible chain and will follow an identical path. Each chain travels around two chain sprockets arranged in vertically spaced positions and rotable about parallel axes. The sprockets for the chain 40 which is visible in FIG. 1 are denoted 88 and 90 and it will be seen that the chain extends in a vertical rectilinear run between the two sprockets which defines the vertical portion 36 of the web path. The other series of pinch bars 38', carried by chains 40' follow a similar but reversed path with a rectilinear run opposed to the rectilinear of chain 40.

Figure 6:
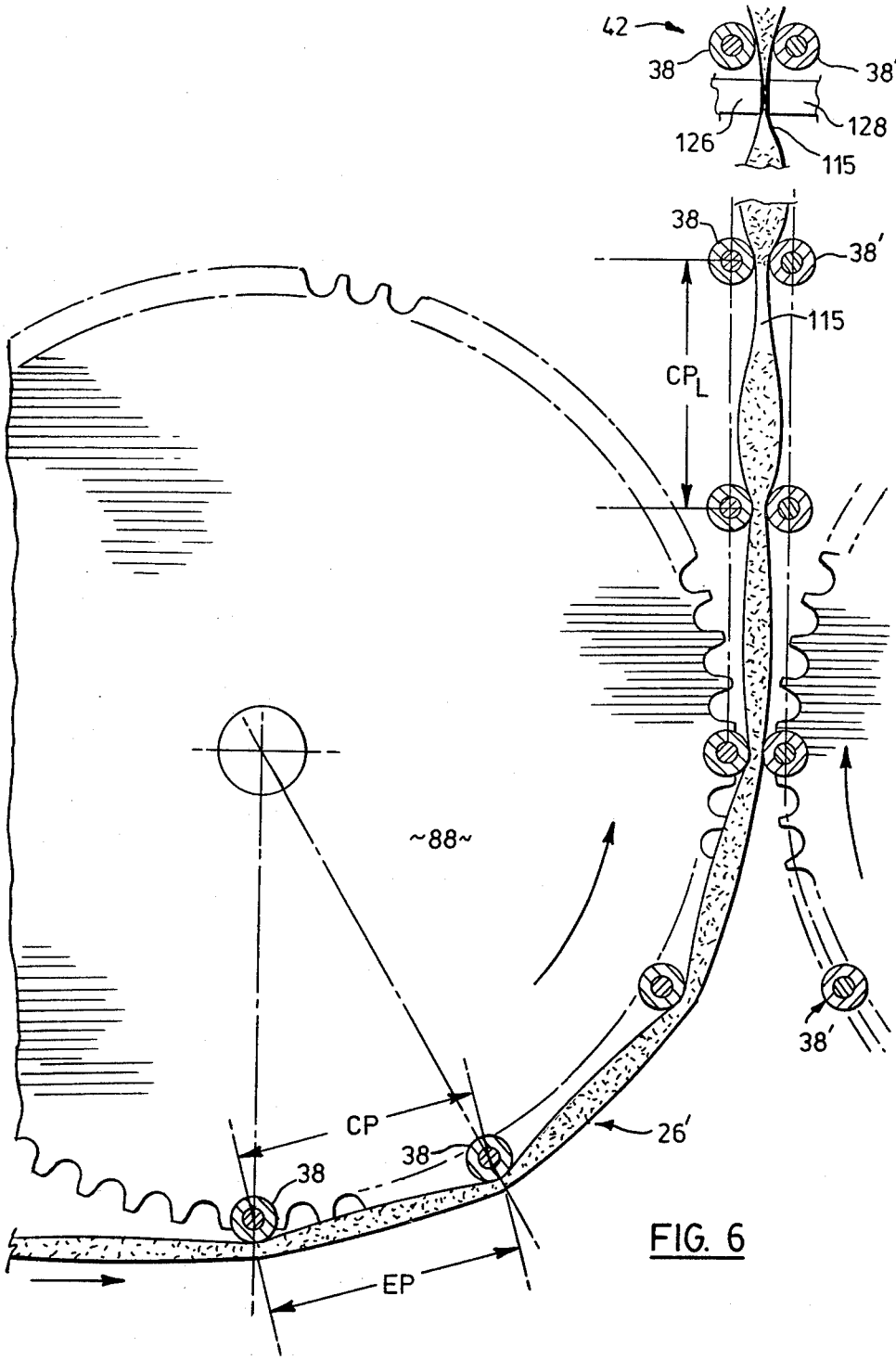
FIG. 6 is an enlarged view of part of FIG. 1.
Figure 7:
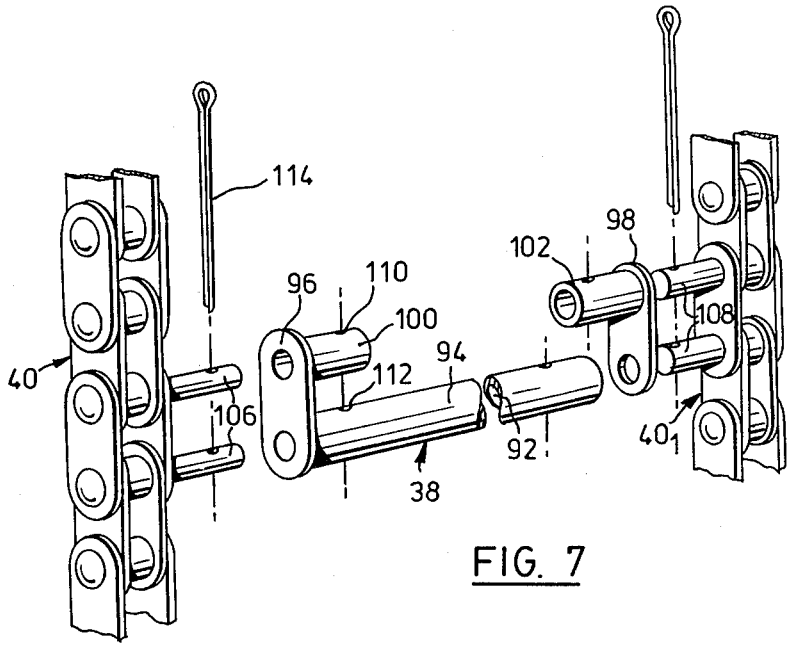
FIG. 7 is a perspective view of part of FIG. 6.

FIG. 6 is a detail view showing part of the sprocket wheel 88 for chain 40 and illustrates the effect of the pinch bars 38 on the tube. For clarity of illustration, the chain itself has not been shown in FIG. 6, but FIG. 7 shows one of the pinch bars 38 and the arrangement employed for coupling that bar to chain 40 and the companion chain, denoted $40_1$. Pinch bar 38 comprises a solid center bar 92 surrounded by a rubber sleeve 94 which is bonded to bar 92. The chains 40 and $40_1$ are conventional roller chains comprising alternating pairs of inner and outer links coupled together by hinge pins fitted with rollers between the inner links. Brazed to the outer ends of the pinch bar rod 92 are respective individual links 96 and 98 which project radially from the rod 92 parallel to one another. The ends of rod 92 are drilled with holes which align with the openings in the inner ends of the links 96 and 98 and the links are also fitted with inwardly extending sleeves 100 and 102 respectively which are aligned with the outer openings in the links and which extend parallel to the rod 92 itself. The pinch bar is then coupled to the respective chains 40 and $40_1$ by providing each chain with a pair of extended hinge pins as the pins 106 and 108 at the location at which the bar is to be attached. The bar is fitted to the chain by engaging the two extended hinge pins through the openings in the link 96 at the end of rod 92 and into the bore in the end of the rod and the sleeve 100. Aligned openings 110 and 112 are provided in sleeve 100 and in the bar itself and corresponding openings are provided in the extended hinge pins 106 to receive a cotter pin 114 for preventing separation of the pinch bar from the chain. A similar coupling arrangement is provided between the pinch bar and the chain $40_1$. It will be appreciated that the pinch bars 38 are coupled to the chains in nonrotatable fashion and, at the same time, maintain the required separation between the chains.

It will also be appreciated that the pinch bars can be located along the chains at any appropriate position (within the length of one chain link) according to the size of tea bag to be manufactured. For example, in a typical application in which the roller chains are of half inch link size, pinch bars will be provided on every fifth link where Canadian size tea bags of 2½" nominal size are to be manufactured, or on every fourth link for manufacturing U.S. size tea bags of 2" nominal size.

Referring back to FIG. 6, the formed and filled tube 26' is brought into contact with the pinch bars 38 adjacent the end of the horizontal portion of its path. At this time, the tube is under slight tension as controlled by the driven sealing roller 84, and begins to move around sprocket 88 in a tension condition. As successive ones of the bars 38 come into contact with the tube they pinch the walls of the tube towards one another at successive locations along pinch lines disposed transversely of the tube and spaced longitudinally of the tube to correspond generally to the required bag length. Thus, the pinch bars 38 extend over the entire width of tube 26'. Although the pinch bars 38 are applied to the upper wall of the tube only, the effect is to pinch or constrict the tube along said pinch line and prevent or at least severely restrict movement of the tea along the tube.

As the tube continues around sprocket 88 and reaches the bottom of the vertical portion of its path, it is also contacted by the pinch bars 38' of the second series. The chains carrying those bars are synchronised with the chains 40 so that the pinch bars 38' co-operate with the bars 38 to pinch respectively opposite sides of the bag at the same location. The tube is effectively gripped by the pinch bars and caused to travel upwardly through the apparatus. As this movement progresses, the tea tends to migrate downwardly under gravity away from each pinch line, creating a voided area below that line such as the area indicated by reference numeral 115 in FIG. 6.

Figure 8:
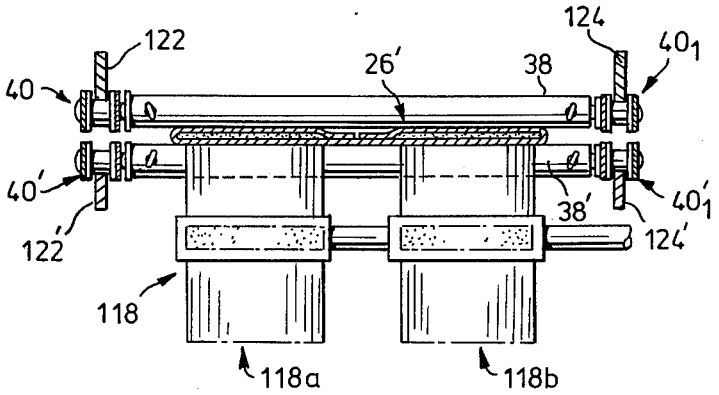
FIG. 8 is a cross-sectional view on line VIII—VIII of FIG. 1.

Referring back to FIG. 1, three rotary brushes 116, 118, and 120 are provided in a group immediately above the lowermost sprocket 88 and 88' and are arranged with one brush (116) at one side of the travelling tube 26' and the other brushes (118 and 120) at the other side of the tube and spaced respectively above and below brush 116. Brush 116 is driven to rotate in the clockwise direction as seen in FIG. 1 while the brushes 118 and 120 both rotate in the counterclockwise direction. Each brush has a central rotary shaft and a series of bristles which project generally radially of the shaft and the brushes are arranged so that their outer end portions gently brush against the tube 26' as it moves upwardly along the vertical portion 36 of its path. This gentle brushing action is found to assist in the downward migration of particles of tea and improve ahd "voiding" action referred to previously. FIG. 8 illustrates the action of brush 118 on the travelling tube. It will be seen that the brush is in fact in the form of two axially spaced sections 118*a* and 118*b*. The sections are spaced to correspond with the spacing of the two rows of tea bags being formed in tube 26'. The other two brushes 116 and 120 are of similar form but have not been shown in FIG. 8.

In order to ensure firm pinching of the filled tube and minimize the risk of seepage of tea past the pinch bars 38 and 38' along the rectilinear portion of the path of the filled tube, two pairs of spring mounted presser bars 122, 122' and 124, 124'0 are provided along this portion of the path of the web. The presser bars act on the rollers of the respective chains to maintain the pinch bars 38, 38' applied against the filled tube. Thus, it will be seen that the bars of the pair 122, 122' bear on the rollers of the chains 40, 40' respectively along the rectilinear runs of those chains. The bars 124, 124' similarly bear on the rollers of the chains $40_1$, $40'_1$. Each of the presser bars will be spring mounted so that it is resiliently urged against the associated chain; however, the spring mounting arrangements have not been specifically shown in the drawings. The presser bars are shown in ghost outline in FIG. 1 and their longitudinal extent can clearly be seen in that view. Means (not shown) may be provided for vibrating the presser bars unison to assist downward migration of tea while maintaining the pinching effect of the pinch bars 38 and 38' on the tube.

In alternative embodiments, the brushes discussed above may be replaced or supplemented by other means for assisting downward migration of tea away from the pinch locations. For example, flails may be employed for repeatedly impacting the tube to assist movement of tea by vibration. In another embodiment, one or more air rollers may be employed adjacent the tube for directing jets of air against the tube. Tha air jets may not only impart vibrations to the tube but may also permeate the porous filter material from which the tube is made to physically displace the particles of tea within the tube. Further, means may be provided for removing from the filled tube, static electricity which might otherwise inhibit the voiding action of the apparatus.

This voiding action is also assisted by the fact that the pinch bar arrangement provided by the invention is designed to allow the filled tube to relax longitudinally after it has passed around the sprocket wheel 88. This relaxation is achieved due to the fact that the pinch bars 38 are of a diameter such that the outer surfaces of the bars extend radially outwardly with respect to sprocket 88 beyond the pitch line of the chains 40 by which the bars are carried. This means that the spacing between the contact points of each adjacent pair of pinch bars is slightly greater than the pitch between the centers of the bars as the bars are travelling around sprocket 88 owing to a "chordal" effect as chain 40 moves around the sprocket, but reduces to a distance equal to the pitch between the pinch bars after the bars have left the sprocket.

Referring specifically to FIG. 6, the chordal pitch between each adjacent pair of pinch bars as they begin to travel around sprocket 88 is denoted by the letters CP. Owing to the fact that the pinch bars extend outwardly beyond the pitch line of the chain, however, the distance between the contact points of the bars with tube 26', or the effective pitch of the bars, denoted EP will be slightly greater than CP. However, when those bars have travelled around the sprocket and entered the vertical rectilinear portion 36 of the path of the tube, the pinch bars will have turned slightly due to the change in direction of the chains 40 so that dimension EP will have reduced and will now be equal to the true linear pitch $CP_L$ of the chain.

By way of example, in a practical embodiment in which the chains 40 are of ½" pitch and sprocket 88 has a pitch diameter of 9.554", if the pinch bars 38 are provided on every fifth link of the chains 40, the chordal pitch CP between the pinch bars will be 2.473". For a pinch bar diameter of ½", the effective pitch EP will be 2.570". The true linear pitch $CP_L$ between the pinch bars will then be 2.50" and the effective pitch EP of the pinch bars will have reduced to the same amount, allowing a corresponding relaxation in the tension of the web.

While the particular arrangement described has been found to be preferable in the sense that no special additional devices are necessary in order to effect the relaxation of the web, it will of course be appreciated that a similar effect may be obtained in other ways.

In any event, referring back to FIG. 6, the filled tube proceeds upwardly along the portion 36 of its path and voided sections 115 are formed below each pinch line. The heat sealing station 42 is indicated diagrammatically in FIG. 6 and two heat sealing jaws are shown, one on each side of the filled tube 26' and are designated respectively be reference numerals 126 and 128. The jaws repeatedly open and close as will be described to heat seal the upper and lower walls of tube 26' together along successive bands extending transversely of the tube to form successive transverse heat seals. The jaws are positioned with respect to the tube and are synchronised with movement of the pinch bars 38' so that each seal is formed in one of the voided areas 115 of the tube; that is, immediately below each co-operating pair of pinch bars 38 and 38'. By virtue of the fact that each of these areas 115 has been voided of tea as described above, these transverse heat seals are formed in "clean" areas of the tube with minimum risk that particles of tea may be trapped in the heat seal.

Referring back to FIG. 1, the heat sealing jaws 126 and 128 are carried by respective rotary drums 130 and 132. The drums ae disposed on respectively opposite sides of the filled tube and are rotatable about parallel horizontal axes in synchronism with the chains 40 and 40'. The driving arrangement which provides for this synchronism will be described in due course with reference to FIG. 10. Thus, each of the drums 130 and 132 carries a series of angularly spaced heat sealing jaws which project generally radially from the surface of the drum for co-operation with similar jaws on the other drum as the two drums rotate. The spacing between the jaws on each drum is selected to correspond with the spacing between each pair of pinch rollers 38 or 38' so that the heat seals formed by the jaws are automatically spaced by the appropriate around longitudinally of tube 26'.

To summarise, it will be recalled that a continuous longitudinal heat seal was formed in tube 26' immediately downstream of the forming and filling station 32 to provide two continuous enclosed streams of tea in the tube, and that those streams have now been separated into individual portions of tea and the tube sealed transversely at the heat sealing station 42. Thus, immediately downstream of station 42, the tube 26' includes a plurality of individual portions of tea each heat sealed in a "pocket" formed by a section of the tube. Each of these "pockets" will form an individual tea bag. The tube is conveyed by the co-operating pinch bars 38' upwardly from heat sealing station 42 and laterally around idler roll 44 to the severing station 46. In an alternative embodiment, roll 44 may be omitted and the tube conveyed in an inclined path directly to the severing station; the pairs of cutter rolls 48 and 50 would then be appropriately oriented to act on the inclined tube.

Figure 9:
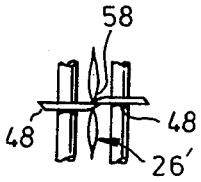
FIG. 9 is a cross-sectional view on line IX—IX of FIG. 1.

FIG. 9 shows the first pair of cutter rolls 48 at severing station 46. Both these rolls and the rolls 50 are entirely conventional and have been described and illustrated merely for completeness. It will be seen that the rolls 48 take the form of a pair of co-operating rotary knives arranged in permanent face-to-face engagement and positioned laterally with respect to tube 26' so as to form a continuous cut centrally through the longitudinal heat seal 58. The cutters are mounted on respective rotary shafts which are continuously driven so that the cutters separate the tube into two continuous strips, each of which includes a series of the "pockets" referred to above, each containing a portion of tea. These strips then pass to the second pair of cutter rolls 50, both of which are also continuously driven. One of these rolls, denoted 50' is a backup roll while the other roll 50'' has a series of equally spaced knives 135 which project generally radially from the periphery of the roll and each of which has an axially parallel cutting edge. The knives 134 are spaced to correspond with the spacing of the transverse heat seals formed in the web at station 42 and the rolls 50 are driven in synchronism with the pinch bars 38 and 38' so that each knife severs the tube along a line disposed generally centrally of one of said transverse heat seals and portions of each seal on opposite sides of the line of severing form end seals of successive bags. As shown in FIG. 1, for example, one of the knives 134 has just severed a tea bag 52 from the tube, and it will be seen that the bag has an end heat seal 136 formed by a portion of the transverse heat seal which was made between that bag and the immediately following bag not yet severed from the tube (denoted 52'). The leading end of that bag also has a portion of that seal at its leading end, as denoted by reference numberal 138. Sometimes, tea bags may be sold in the form of a strip of interconnected bags, in which case the bags may be severed from the tube in groups rather than individually, each group forming a strip of interconnected bags. Lines of perforation may then be provided between the individual bags in each group.

Figure 10:
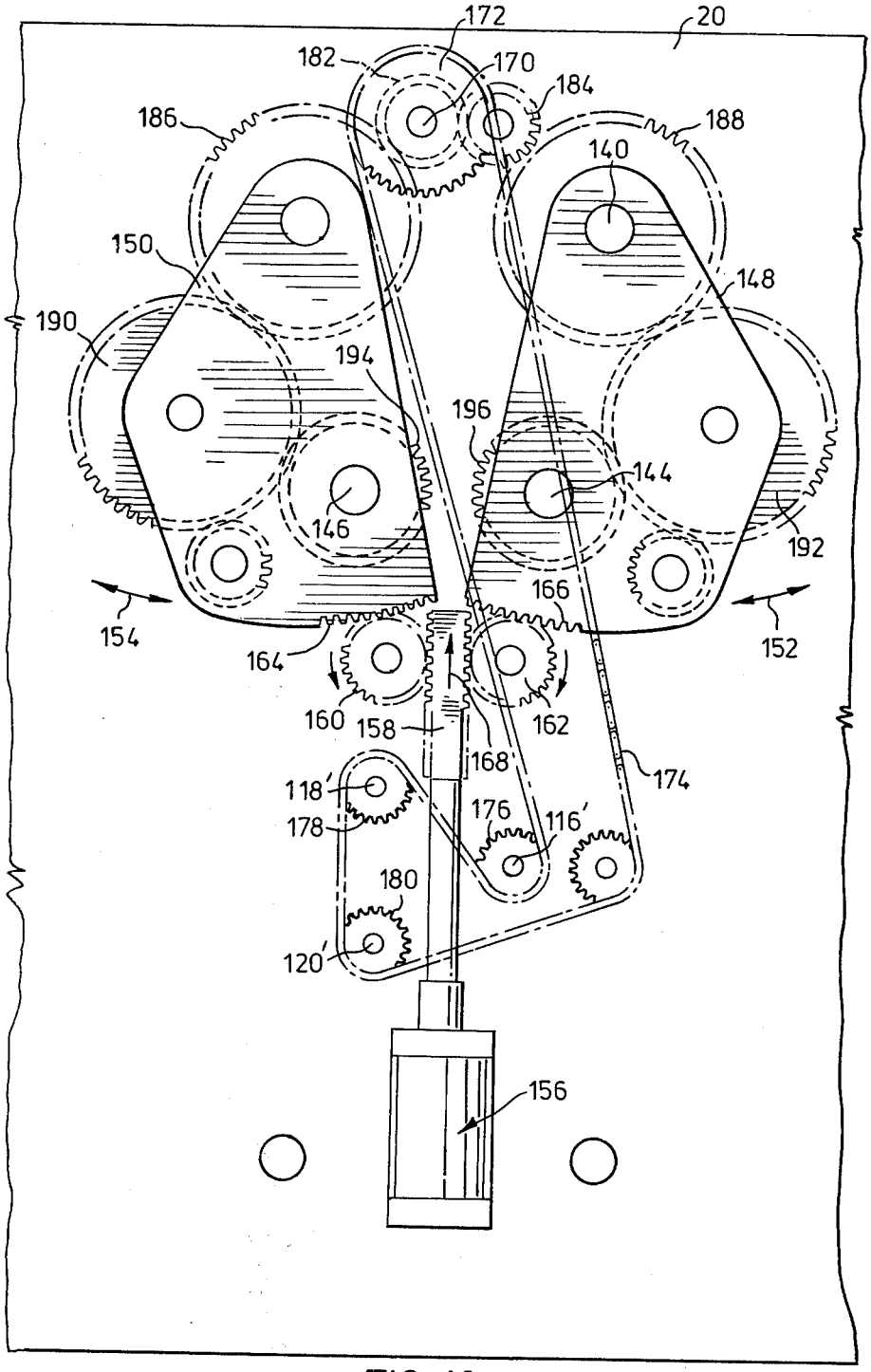
FIG. 10 is a view from the rear of part of FIG. 1 and illustrates the drive arrangements of that part of the apparatus.

FIG. 10 is a view from the rear of the part of FIG. 1 which includes the chains 40 and 40' and the pinch bars and including the heat sealing station 42 and the brushes 116, 118 and 120, and illustrates the drive arrangement for these components and an arrangement for separating the heat sealing drums when movement of the web stops. The rear face of base plate 20 is visible in FIG. 10 as are a number of shafts which project through the base plate from its front face and which carry certain of the rotatably mounted components visible in FIG. 1. These shafts are also visible in that view and are denoted by the following reference numerals which are also used in FIG. 10. Referring primarily to FIG. 1, the shafts which carry the two chain sprockets 90 and 90' are denoted respectively 140 and 142. The heat sealing drums 130 and 132 are mounted on respective shafts 144 and 146 and the shafts carrying the brushes 116, 118 and 120 are denoted respectively 116', 118', and 120'. With the exception of the shafts 144 and 146 carrying the heat sealing drums 130 and 132, the remaining shafts are rotatably mounted in the base plate 20 and the components driven by these shafts are rigidly secured thereto.

Referring now particularly to FIG. 10, the shafts 134 and 136 carrying the heat sealing drums 130 and 132 are mounted at the rear side of base plate 20 on respective guadrants 148 and 150, each of which is pivoted adjacent its upper end on one of the shafts 140 and 142. Arcuate slots (not shown) are provided in base plate 20 for the respective shafts 144 and 146 and the quadrants are pivotable outwardly as indicated by the arrows 152 and 154 to bring the heat sealing drums 130 and 132 out of contact with the filled tube when the apparatus has stopped. This movement of the quadrants will be automatically linked to the main drive motor of the apparatus so that the heat sealing drums will be automatically removed from the tube, thereby avoiding burning of the web, without the need of human intervention.

Movement of the quadrants 148 and 150 between the "ON" and "OFF" positions of the heat sealing drums is effected by a verically mounted pneumatic cylinder and ram device 156, the ram of which is coupled to a vertically movable rack 158. Rack 158 meshes with two pinions 160 and 162 disposed on opposite sides of the rack and each of the pinions in turn meshes with a toothed segment on the bottom edge of one of the quadrants, as indicated by reference numerals 164 and 166. As shown in FIG. 10, the heat sealing drums are in their "ON" positions. If the ram of device 156 is now extended as indicated by arrow 168, the pinions 160 and 162 will be rotated in opposite directions as shown, causing the quadrants 148 and 150 to move apart and lift the drums away from the tube. Conversely, by retracting the ram of the device, the heat sealing drums will be returned to the tube. Extension and retraction of the ram of device 156 will be controlled automatically by a pneumatic valve (not shown) coupled in the main drive system of the apparatus as will be apparent to a person skilled in the art.

The component driving shafts shown in FIG. 10 are all driven in rotation from a common drive source in synchronism with one another. A main drive input shaft is indicated at 170 in FIG. 10 and is fitted with a sprocket 172 which drives an endless chain 174. The chain passes around appropriately sized driven sprockets 176, 178 and 180 on the shafts for driving the brushes 116, 118 and 120 (FIG. 1).

The main drive shaft 170 also carries a driven gear wheel 182 which in turn drives a second similar gear wheel 184. These two gear wheels in turn mesh with respective, larger gear wheels 186 and 188 mounted on the two drive shafts 142 and 140 respectively for the chain sprockets 90 and 90' (FIG. 1). Thus, the chains carrying the pinch bars are automatically driven in synchronism with the main drive shaft and with the brushes 116, 118 and 120. Gear wheels 186 and 188 also mesh with further, similar gear wheels 190 and 192 which in turn mesh with other, somewhat smaller gear wheels 194 and 196 mounted on the drive shafts 146 and 144 for the heat sealing drums 130 and 132. Of course, the sizes of the various sprockets and gear wheels are carefully chosen to provide the required, related speeds for the various components.

Figure 11:
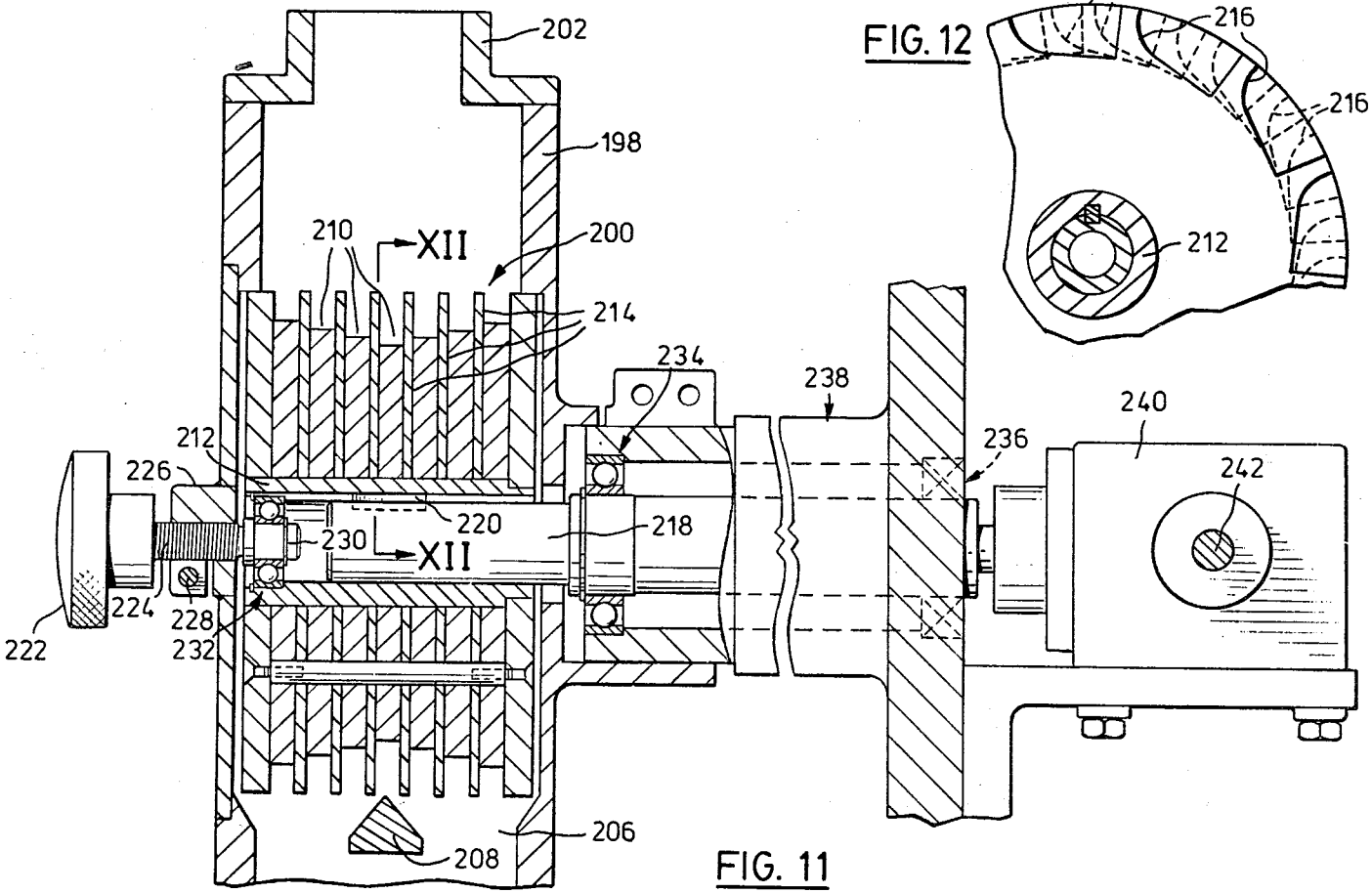
FIG. 11 is a cross-sectional view on line XI—XI of FIG. 1.

FIG. 11 illustrates in detail the form of the tea filling device 68 used for introducing the two streams of tea into the tube formed from web 26. Device 68 includes a casing 198 housing a rotor 200 which is driven from the main drive system of the machine to feed tea from the device at a controlled rate as will be described. Above rotor 200, casing 198 defines the space which provides a reservoir of tea for rotor 200. Casing 198 has an inlet 202 at its upper end for mounting a supply hopper such as that indicated at 204 in FIG. 1. At its lower end, casing 198 has an outlet 206 which is coupled to the chute 64 shown in FIG. 2. A fixed divider 208 is provided in outlet 206 immediately below rotor 200 for dividing the tea leaving the rotor into the two streams required by the apparatus and as discussed previously. Divider 208 aligns with the member 72 in chute 64 (FIG. 2).

Figure 12:
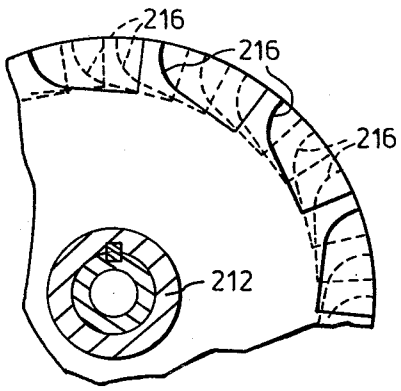
FIG. 12 is a partial sectional view on line XIII—XIII of FIG. 11.

Rotor 200 comprises a series of pocketed discs 210 which are mounted on a sleeve form hub 212 and are separated by circular plates 214. FIG. 12 shows a detail of one of the plates 210 and it will be seen that the plate is provided in its peripheral margin with a series of spaced pockets 216 for receiving tea. The other plates 210 are of similar form and the plates are angularly offset with respect to one another about the longitudinal axis of hub 212. As a result of this construction, rotor 200 in effect presents a almost infinite number of outwardly opening tea receiving pockets so that when the rotor rotates a continuous uninterrupted stream of tea is delivered by the rotor.

The rotor hub 212 is mounted on a drive shaft 218 and is coupled to the shaft by a key 220 slidably received in a keyway on the shaft so that the rotor has the facility for limited axial sliding movement with respect to the shaft. An adjustment screw 222 is provided at an end of casing 198 and is disposed in axial alignment with shaft 218. Screw 222 has a screw threaded portion 224 received in a complimentarily internally screw threaded bore in a housing 226 on the rotor casing 198. Housing 226 is in fact a split housing and a screw 228 is provided so that the housing can in effect be clamped onto the screw to lock the same in an adjusted position. At its inner end, screw 224 has a plain portion 230 coupled to the inner race of a ball bearing assembly 232. The outer race of assembly 232 is coupled to the hub 212 of rotor 220. Thus, it will be appreciated that turning of screw 224 will cause axial displacement of bearing assembly 233 and that, since assembly 232 is coupled to the rotor hub 212, corresponding axial movement of the rotor will follow. This arrangement allows the rotor to be axially adjusted to balance the amount of tea in each of the two streams being delivered to the tube formed from web 26.

Rotor drive shaft 218 is rotatably mounted in bearings 234 and 236 in a bearing housing 238 which projects from one side of the rotor housing 198. A gear box 240 is in turn coupled to drive shaft 218 and the gear box has a input shaft 242 which is driven from the main drive motor of the apparatus. Gear box 240 is an infinitely variable type of gear box and accordingly provides for infinite variation in the speed of rotation of the rotor 200. Accordingly, infinite variation is possible in the rate at which tea is delivered from device 68 and in the amount of tea in each bag produced by the apparatus.

It will of course be appreciated that the preceding description relates to a specific embodiment of the invention and that many modifications are possible within the broad scope of the claims. For example, the apparatus described previously is designed to produce two rows of bags from a single formed tube by virtue of the longitudinal heat seal formed in the tube. These bags would be of the three seal type having a fold along a fourth side of the bag. In an alternative embodiment, however, the central longitudinal heat seal could be omitted and a single row of bags produced from the tube. Conversely, more than two rows of bags could be produced by providing a wider tube and forming more than one longitudinal heat seal. Also, instead of forming the tube from a single web as described, it would of course be possible to use two webs heat sealed one on top of the other.

Further, in the described embodiment, the tea is carried vertically upwardly in order to produce the "voiding" effect described prior to formation of the transverse heat seal. This is not essential. In another embodiment, the tube could be conveyed in an inclined upwardly extending path. Also, instead of using pinch bars carried by roller chains, other forms of pinching arrangements may be provided. For example, toothed belts may be used for this purpose.

The expression "tea or the like" as used herein is intended to indicate that the bags may contain fluent materials other than tea, e.g. coffee.

The apparatus provided by the invention also has the advantage that features such as forming the bags with gussets and providing tags for facilitating immersion of a bag in water may be readily incorporated. Gussets may be formed at the tube forming and filling station 32 by providing additional folding means for forming continuous inwardly directed longitudinal folds along opposite sides of the tube. Tags may be provided on the web from which the tube is formed generally disclosed in either of U.S. Pat. Nos. 2,954,294 and 2,987,857 (both to Whelan).

What I claim as my invention is:

1. A method of manufacturing tea bags and like comprising the steps of:

continuously forming at least one web of a porous heat sealable material into a flattened, closed tube having opposed upper and lower walls while introducing a continuous stream of tea and the like into said tube;

causing the tube to travel generally horizontally following said introduction of tea and the like;

pinching the tube to cause said upper and lower walls to move towards one another at successive locations along pinch lines disposed transversely of the tube and spaced longitudinally of the tube to correspond generally to the required bag length;

subsequently causing the tube to travel upwardly so that the tea and the like tends to migrate downwardly under gravity away from each said pinch line, creating a voided area immediately below each pinch line;

heat sealing said upper and lower walls of the tube together along successive bands each disposed in one of said voided areas of the tube and extending transversely of the tube to form a heat seal; and, separating successive sections fron the tube to form individual tea and like bags or groups of such bags by severing the tube along lines each disposed generally centrally of one of said heat seals so that portions of each seal on opposite sides of said line form end seals of successive bags.

2. A method as claimed in claim 1, further comprising the step of causing the spacing between said pinch lines to decrease during said upward travel as a tube so that the walls relax and assist said downward migration of the tea and the like.

3. A method as claimed in claim 2, wherein said step of causing the spacing between said pinch lines to decrease is performed by:

causing the tube to travel parallel to and outwardly of an arcuate path extending about a center of arc following said horizontal path of the tube;

providing a plurality of pinch elements which project outwardly from said path generally radially of said center and which travels successively around said path with successive pair of elements describing chords of said arc;

causing outer ends of said elements to successively engage the tube along said pinch lines; and, subsequently causing said elements to convey the tube vertically upwardly to a heat sealing station at which said heat seals are formed, whereby said outer ends of the pinch elements move towards one another in travelling from said arcuate path into said vertical direction and cause said relaxation of the walls of the tube.

4. A method as claimed in claim 3, wherein said pinch elements comprise a first series of elements, and wherein the method comprises a further step of providing a second series of pinch elements and causing the elements of said second series to co-operate with the elements of said first series to pinch the tube from both sides in travelling vertically to said heat sealing station.

5. A method as claimed in claim 1, comprising the further step of brushing at least one wall of the tube during its said upward travel to agitate said tea and the like and thereby allow its downward migration.

6. A method as claimed in claim 1, comprising the further steps of: forming at least one longitudinal heat seal in said tube during formation of the tube to define at least two continuous passageways extending longitudinally of the tube and introducing continuous streams of tea into each of said passageways; and severing said tube longitudinally generally centrally of said longitudinal heat seal after formation of said transverse heat seals.

7. Apparatus for manufacturing tea bags and the like comprising:

means for continuously conveying at least one web of a porous heat sealable material from a supply along a path which includes a generally horizontal portion, followed by an upward portion;

means for forming said at least one web into a flattened closed tube having uper and lower walls while introducing a continuous stream of tea and the like into said tube;

means for pinching the tube to cause said upper and lower walls of the travelling tube to move towards one another at successive locations along pinch lines disposed transversely of the tube while the tube is travelling along said generally horizontal portion of its path, said lines being spaced longitudinally of the tube to correspond to the required bag length, said pinching means being adapted to maintain the tube in its pinched condition along said upward portion of its path so that the tea and the like tends to migrate downwards under gravity away from each said pinch line, creating a voided area immediately below each said line;

means fo heat sealing said upper and lower walls of the tube together along successive bands each disposed in one of said voided areas of the tube and extending transversely of the tube, to form a heat seal;

means for separating successive sections from the tube to form individual tea and like bags or groups of bags, said means being adapted to sever the tube along lines each disposed generally centrally of one of said heat seals so that portions of each seal on opposite sides of said line form end seals of successive bags.

8. Apparatus as claimed in claim 7, wherein said means for pinching the tube comprise first and second endless conveyors each arranged to follow a path which includes a rectilinear portion along which the conveyors co-operate to define said upward portion of the path of the formed tube, each conveyor including a plurality of transversely extending pinch elements adapted to form said pinch lines on the tube, said conveyors being synchronised so that the pinch elements co-operate to pinch the tube from both sides along said upward portion of the path, and wherein one of said conveyors is disposed adjacent said horizontal portion of the path of the tube and is arranged to engage and pinch the tube from one side adjacent an end of said portion of its path and to maintain the tube in a pinched condition as the tube travels to said upward portion of its path.

9. Apparatus as claimed in claim 8, wherein each conveyor comprises two endless chains and a plurality of pinch bars extending transversely between the chains at a predetermined space from one another and coupled to said chains in nonrotatable fashion.

10. Apparatus as claimed in claim 8 wherein each of said conveyors two endless chains and a plurality of hinge bars extending transversely between the chains at a predetermined space from one another and coupled to said chains in nonrotatable fashion, and wherein the chains of said one conveyor extend around parallel sprockets adjacent said horizontal portion of the path of the tube, so that the chains travel along an arc from said horizontal portion to said upward portion of the tube path, and wherein said pinch bars are dimensioned to project outwardly from said arc and are spaced along said chains so that successive pairs of said bars describe chords of said arc in travelling therearound, said bars having outer surface portions for contact with the tube and being dimensioned so that said surfaces of successive pairs of said bars move towards one another as the chains travel from said sprocket to said upper portion of the path of the tube, whereby the tube is caused to relax and assist said migration of tea.

11. Apparatus as claimed in claim 8, further comprising at least one rotary brush disposed adjacent said upward portion of the path of the tube and arranged to apply a brushing action to the tube in a direction to assist said downward migration of tea.

12. Apparatus as claimed in claim 8, wherein said heat sealing means is disposed adjacent said rectilinear runs of the conveyors and comprises two heat sealing drums each having a plurality of heat sealing jaws projecting generally radially therefrom, said rums and said conveyors being synchronised so that the jaws co-operate to form said transverse heat seal from both sides of the tube and automatically in said voided areas of the tube.

13. Apparatus as claimed in claim 12, further comprising first and second support means each carrying one of said heat sealing drums, means pivotally mounting said support means for movement between first positions in which said drums are positioned to form said heat seals, and second positions in which the drums are disposed remote from said tube, and means for simultaneously moving said support means between their said positions at appropriate times.

14. Apparatus as claimed in claim 7, wherein said means for forming the web into a tube and introducing tea and the like into the tube comprise a device for providing a continuous stream of tea and the like, a chute receiving tea from said device and having an outlet adjacent a lower end thereof, and a folding form disposed adjacent said lower end of the chute and adapted to fold said web about said outlet.

15. Apparatus as claimed in claim 14, wherein said feeding device comprises a casing defining a reservoir for tea and the like, a rotor disposed in said casing in communication with said reservoir and having an outer surface covered with pockets for receiving said tea and the like, said casing having an outlet to which said tea and the like is fed in a continuous stream by rotation of said rotor, and drive means for said rotor adapted to provide an infinitely variable drive speed for varying the amount of tea delivered by said device.

16. Apparatus as claimed in claim 14, wherein said chute defines at least two passageways for delivering two continuous streams of tea to said tube, and wherein the apparatus further comprises means for forming at least one continuous longitudinal heat seal between said streams of tea, and means for continuously severing said longitudinal heat seal generally centrally thereof downstream of said heat sealing means.

17. Apparatus as claimed in claim 14, wherein said chute defines at least two passageways for delivering two continuous streams of tea to said tube, and wherein the apparatus further comprises means for forming at least one continuous longitudinal heat seal between said streams of tea, and means for continuously severing said longitudinal heat seal generally centrally thereof downstream of said heat sealing means, and wherein the feeding device further comprises means for adjusting the position of said rotor in said casing in the axial direction to vary the relative quantities of tea in said two streams.

* * * * *